US006119659A

United States Patent [19]

Wright

[11] Patent Number: 6,119,659

[45] Date of Patent: Sep. 19, 2000

[54] FUEL INJECTOR HAVING EXTENDED VOLTAGE RANGE

[75] Inventor: Danny O. Wright, Cobb's Creek, Va.

[73] Assignee: Siemens Automotive Corporation, Auburn Hills, Mich.

[21] Appl. No.: 09/206,421

[22] Filed: Dec. 7, 1998

[51] Int. Cl.[7] ..... F02M 51/00; H01H 47/32

[52] U.S. Cl. ..... 123/490; 361/154

[58] Field of Search ..... 251/129.01; 361/154, 361/194, 155, 187; 123/490

[56] References Cited

U.S. PATENT DOCUMENTS 4,338,651 7/1982 Henrich ..... 361/154 X 4,417,201 11/1983 Reddy ..... 123/490

5,937,828 8/1999 Watanabe ..... 123/490

5,975,057 11/1999 Repplinger et al. ..... 123/490

*Primary Examiner*—Kevin Lee

[57] ABSTRACT

A fuel injector apparatus includes an electromagnetic fuel injector having a housing and a magnetic circuit in the housing. The magnetic circuit including an electromagnetic coil constructed and arranged to operate at a nominal voltage to open the fuel injector. The nominal voltage is substantially less that a supply voltage. Circuit structure is electrically coupled with the coil and is constructed and arranged to step-down the supply voltage to be substantially the nominal voltage at the coil.

20 Claims, 3 Drawing Sheets

FUEL INJECTOR HAVING EXTENDED VOLTAGE RANGE

CROSS-REFERENCE TO RELATED APPLICATION

This application expressly claims the benefit of earlier filing date and right of priority from the following co-pending patent application: Provisional Application U.S. entitled "Fuel Injector Having Extended Voltage Range," filed on Nov. 3, 1998. Cited patent application is expressly incorporated in its entirety by reference.

FIELD OF THE INVENTION

This invention relates to fuel injectors for internal combustion engines and more particularly to fuel injectors having circuit structure to permit the fuel injector to operate not only in a conventional 12 volt vehicle electrical system but also in a higher voltage vehicle electrical system, such as a nominal 42 volt electrical system.

BACKGROUND OF THE INVENTION

The application conventional 12 volt electronic fuel injectors to automotive electrical systems of much higher voltage such as, for example 42 volts, presents problems to the fuel injector design. Assuming that the typical size of the fuel injector cannot change, and that the fuel injector will most likely be driven by a saturated switch electronic control unit (ECU), major modifications in the coil design of existing injectors will be required. For example, if an existing 14 ohm fuel injector coil consists of 525 turns of #34.5 AWG copper wire, the corresponding coil for a 42 volt operation must be a 126 ohms consisting of 1575 turns of #38.5 AWG copper wire. These calculations follow from the requirement of providing the same number of ampere-turns for an acceptable magnetic force and of maintaining the power dissipation the same in the injector. The use of extremely fine gauge wire is not feasible in the rugged fuel injector environment. For example, by way of comparison, wire size #36 AWG is generally the same thickness as a human hair. Alternate solutions such as adding a voltage dropping resistor in series with the fuel injector coil are feasible, but this solution wastes power and generates substantial heat. Likewise, modifying the standard ECU drivers to regulate injector current is an expensive option, especially when systems of 12 volt and 42 volt capacity may be co-existing in the automotive market for several years.

Accordingly, there is a need to provide a fuel injector having circuit structure to step-down a vehicle electrical system voltage, which is substantially greater than a nominal operating voltage of a fuel injector, to be substantially the nominal operating voltage of the fuel injector.

SUMMARY OF THE INVENTION

An object of the present invention is to fulfill the need referred to above. In accordance with the principles of the present invention, this objective is obtained by providing a fuel injector apparatus including an electromagnetic fuel injector having a housing and a magnetic circuit in the housing. The magnetic circuit includes an electromagnetic coil constructed and arranged to operate at a nominal voltage to open the fuel injector. The nominal voltage is substantially less than a supply voltage. Circuit structure is electrically coupled with the coil and is constructed and arranged to step-down the supply voltage to be substantially the nominal voltage at the coil.

In accordance with another aspect of the invention, circuit structure is provided for controlling a voltage supplied to a fuel injector. The fuel injector has an electromagnetic coil which, when actuated with a nominal voltage, opens the fuel injector. The nominal voltage is substantially less than a supply voltage. The circuit structure includes a circuit constructed and arranged to be electrically connected with the coil and to step-down the source voltage to be substantially the nominal voltage at the coil.

In accordance with yet a further aspect of the invention, a method is provided to step-down a supply voltage directed to an electromagnetic coil of a fuel injector. The coil is constructed and arranged to operate at a nominal voltage which is substantially less than the supply voltage. The method includes providing circuit structure electrically coupled with the coil to step-down the supply voltage to be substantially the nominal voltage at the coil.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENTS

Figure 1:
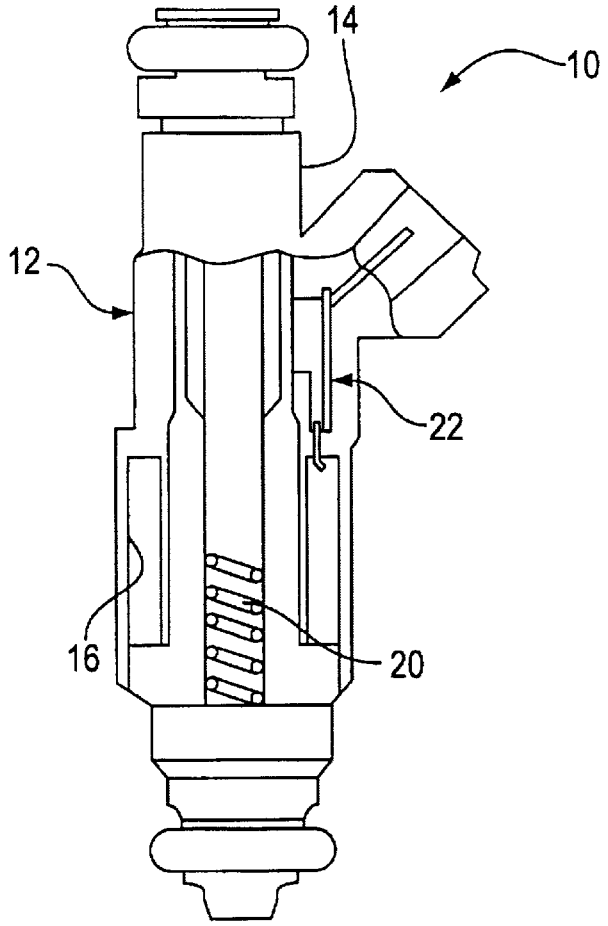
FIG. 1 is partially cut-away schematic illustration of a fuel injector apparatus provided in accordance with the principles of the present invention.

Referring to FIG. 1, a fuel injector apparatus is shown, generally indicated at 10, provided in accordance with the principles of the present invention. The fuel injector apparatus 10 comprises an electromagnetic fuel injector, generally indicated at 12, having a housing 14. A magnetic circuit is disposed in the housing 14. The magnetic circuit includes an electromagnetic coil 16 for opening the fuel injector. The fuel injector 12 is configured to operate at a nominal voltage of 14 volts in a vehicle electrical system employing a 12 volt battery. The fuel injector 12 is of the conventional solenoid type wherein when the solenoid is energized, a valve spring 20 is overpowered and an injector valve (not shown) moves from a closed position to an opened position. When the power to the solenoid is cut-off, the spring 20 returns the injector valve to the closed position preventing the flow of fuel to the intake manifold of the vehicle.

With reference to FIG. 1, the overall length of the top-feed fuel injector apparatus is generally 75 mm, while the diameter of the fuel injector apparatus is approximately 21 mm. These dimensions are merely exemplary. Other sizes can of course be provided.

Figure 2:
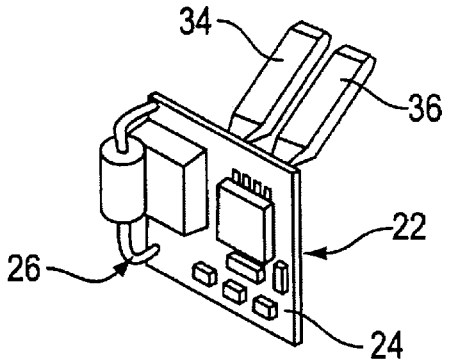
FIG. 2 is a perspective view of a circuit board assembly of the fuel injector apparatus of FIG. 1.

A circuit board assembly, generally indicated at 22, is disposed in the housing 14 and is electrically connected to the electromagnetic coil 16 to excite the coil. The circuit board assembly 22 comprises a circuit board 24 which carries circuit structure, generally indicated at 26. As shown in FIG. 2, two connector pins 34 and 36 are required which are constructed and arranged to mate with a conventional two-pin receiving wiring harness 37, shown schematically in FIG. 4.

In the automobile industry, there is movement towards employing a 36 volt electrical system instead of the conventional 12 volt system. With a 36 volt system, a nominal 42 volts is generally supplied during vehicle operating conditions due to continuous charging of the battery by an alternator. This supply voltage must be reduced to operate the conventional 14 volt fuel injector. The circuit structure 26 of the fuel injector apparatus 10 steps the high supply voltage down to be a substantially lower voltage at the injector coil 16. Thus, in accordance with the principles of the present invention, the circuit structure 26 employs an electronic switchmode circuit as a step-down (bucking) dc-dc voltage converter. The coil 16 itself serves the function of the inductive (bucking) coil of the circuit structure 26.

Figure 3:
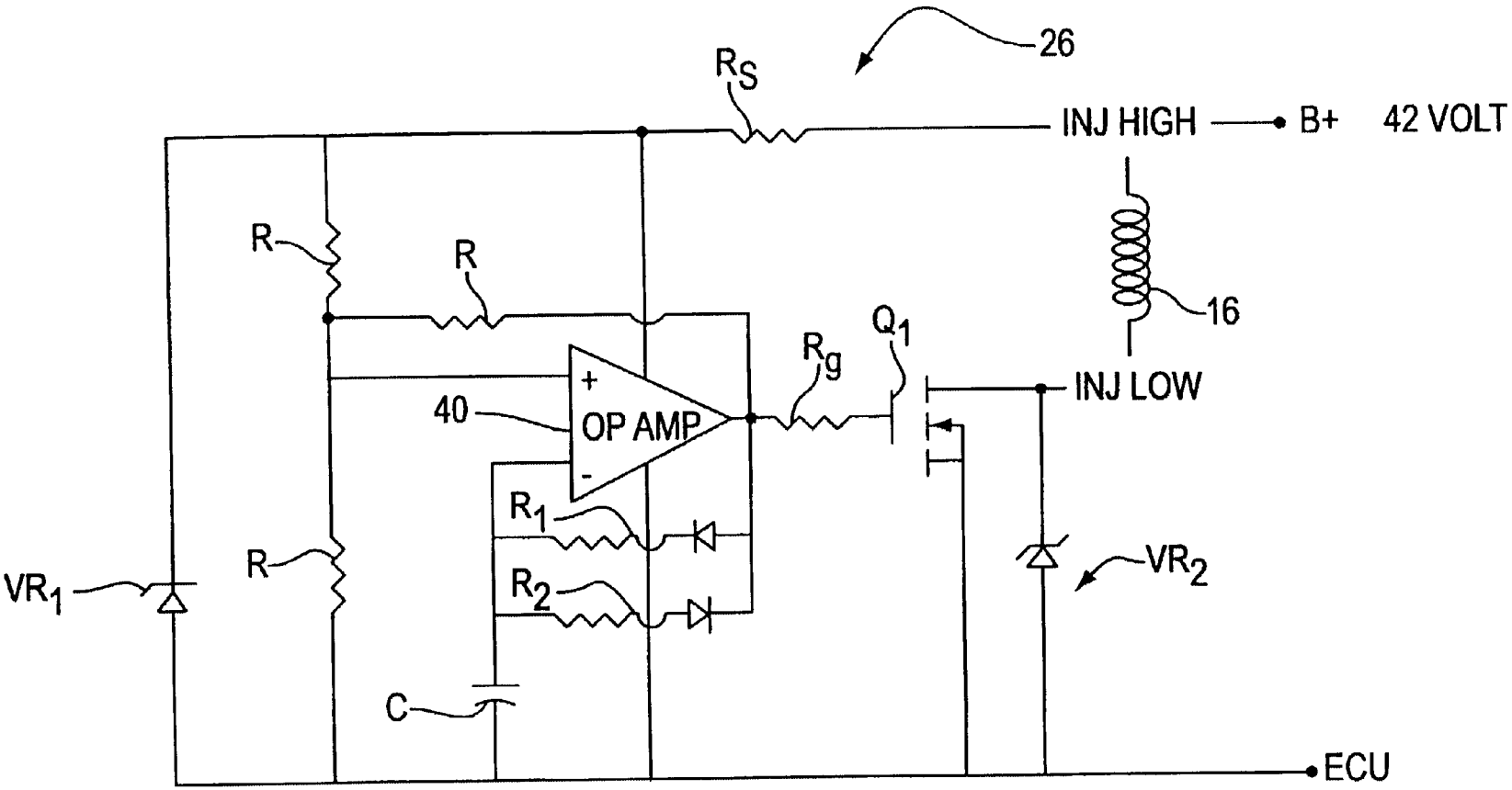
FIG. 3 is a schematic diagram of an embodiment of a circuit structure of the circuit board assembly of FIG. 2, shown electrically connected to an injector coil.
Figure 4:
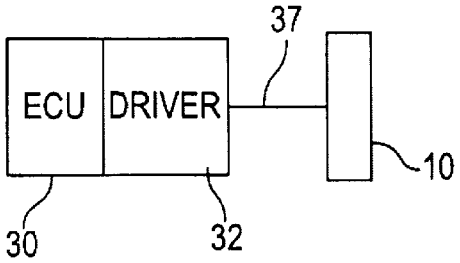
FIG. 4 is a block diagram of the fuel injector apparatus of the invention coupled with an electronic control unit.

A preferred embodiment of the circuit structure 26 is shown schematically in FIG. 3. The circuit structure 26 includes a first terminal B+ which is connected to the positive terminal of a 36 volt vehicle battery which provides a supply voltage of generally 42 volts to the circuit structure 26 when the vehicle is operating. The high side of the coil 16 is connected to the terminal B+. Terminal "ECU" is connected to an electronic control unit(ECU) 30 of the vehicle (FIG. 4). The operation of the circuit structure 26 is initiated when the terminal "ECU" is switch to ground via the driver stage of the ECU 30 on the vehicle. The operational amplifier 40, in conjunction with voltage reference VR1 and equal value resistors R establish a hysteresis voltage range of 1/3 VR to 2/3 VR. Capacitor C will charge via R1 to the upper voltage range and then discharge via R2 to the lower voltage range. This charge/discharge oscillator action results in a square wave signal appearing at the gate of the power Mosfet transistor Q1 via resistor Rg. The low side of coil 16 is connected to the output of transistor Q1. The duty cycle of the oscillation is controlled by the ratio of R1 a to R2 and is selected to provide the desired dc-dc voltage down conversion. In the case of 42V to 14V conversion, the duty cycle desired would be 33⅓%. The absolute frequency of the hysteresis oscillator is selected by the capacitor C to be approximately ten times faster than the L/R ratio for the coil 16 of the fuel injector. In the nominal case, the ratio is on the order of 1 millisecond. Thus, the oscillator frequency is approximately 10 kilohertz. Power zener VR2 must be selected to be always greater than the operating range of the system (42V in the embodiment). At the termination of the desired fuel injection pulse period, terminal "ECU" is released by the vehicle ECU 30 and the current in the injector coil 16 decays rapidly via VR2 and the internal vehicle ECU driver state zener in the normal manner.

As noted above, the selection of resistor values of R1 and R2 determines the switchmode duty cycle and thus the voltage step-down ratio. In the illustrated embodiment, for 42 to 14 volt conversion, the value of R1 must be three times the value of R2.

With reference to FIG. 4, the fuel injector apparatus 10 having the circuit structure 26 is used in combination with a readily available ECU 30 having a saturated switch driver 32.

The entire circuit structure 26 is self-starting, requiring only voltage from the vehicle's battery supply and circuit continuity provided by the normal switch to "ground" action of the ECU's saturated mode driver. Since the operation of the circuit structure 26 is switchmode, power dissipation is minimized and will be less than ½ watt for most applications.

Figure 5:
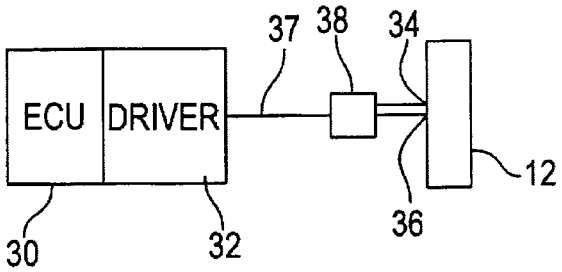
FIG. 5 is a block diagram of a fuel injector apparatus of the invention coupled with an electronic control unit via an adapter containing the circuit structure of the invention.

In the illustrated embodiment, the circuit structure 26 is provided inside the fuel injector 12. However, it is within the contemplation of the invention to package the circuit structure 26 with the step-down electronics in a separate adapter 38 (FIG. 5) which interfaces directly between the automobile wiring harness 37 and the pins 34 and 36 of the fuel injector 12. In this case, the fuel injector 12 is unchanged for 12 or 42 volt applications.

Further, although a specific step-down from 42 volts to 14 volts has been described, it can be appreciated that other conversion ratios are certainly possible by employing the circuit structure 26 of the invention.

Figure 6:
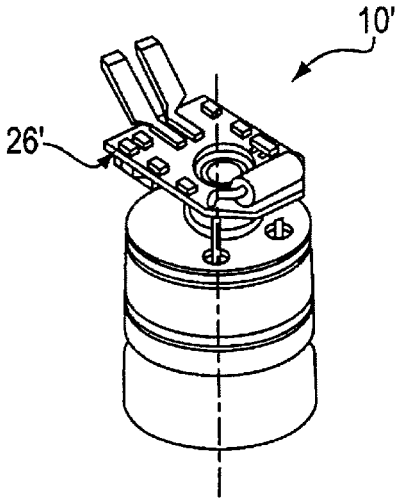
FIG. 6 is a perspective view of a bottom feed fuel injector apparatus provided in accordance with the principles of the present invention.

Although the illustrated embodiment depicts a top-feed fuel injector apparatus, the invention is applicable to a bottom-feed injector as well. An example of a bottom feed fuel injector assembly is shown generally indicated at 10' in FIG. 6. The injector 10' includes the voltage step-down circuit structure 26' as discussed above.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector apparatus comprising:

an electromagnetic fuel injector having a housing and a magnetic circuit in said housing, said magnetic circuit comprising an electromagnetic coil constructed and arranged to operate at nominal voltage to open the fuel injector, said nominal voltage being substantially less than a supply voltage, and a circuit structure directly electrically coupled with said coil, said circuit structure constructed and arranged to step-down the supply voltage to be substantially said nominal voltage at said coil.

2. The fuel injector apparatus according to claim 1, wherein said circuit structure is disposed within said housing.

3. The fuel injector apparatus according to claim 1, wherein said circuit structure is housed in an adapter separate from said fuel injector apparatus, said adapter being constructed and arranged to be electrically connected to said fuel injector apparatus.

4. The fuel injector apparatus according to claim 2, wherein said circuit structure is part of a circuit board assembly.

5. The fuel injector apparatus according to claim 1, in combination with an electronic control unit having a driver to operate said circuit structure.

6. The fuel injector apparatus and electronic control unit combination according to claim 5, wherein said driver is a saturated switch fuel injector driver.

7. The fuel injector apparatus according to claim 1, wherein said electromagnetic coil defines a bucking coil of said circuit structure.

8. The fuel injector apparatus according to claim 1, wherein said circuit structure includes an operational amplifier, a voltage reference, equal value resistors, a capacitor, a transistor having an output directed to said coil, and a pair of calibrating resistors constructed and arranged such that said operational amplifier in conjunction with said voltage reference and said equal value resistors establishes a hysteresis voltage range including an upper voltage and a lower voltage, said capacitor charges to said upper voltage and then discharges to said lower voltage to provide a voltage oscillation which results in a square wave signal being directed to said transistor, a duty cycle of said voltage oscillation being controlled by a ratio of said pair of calibrating resistors to provide the voltage step-down from the supply voltage to said nominal voltage.

9. The fuel injector apparatus according to claim 8, wherein said calibrating resistors are constructed and arranged to provide a voltage step-down ratio of 3 to 1.

10. The fuel injector apparatus according to claim 2, wherein said housing and said circuit structure are constructed and arranged so that said fuel injector apparatus may function as a bottom-feed fuel injector.

11. The fuel injector apparatus according to claim 2, wherein said housing and said circuit structure are constructed and arranged so that said fuel injector apparatus may function as a top-feed fuel injector.

12. The fuel injector apparatus according to claim 1, wherein said nominal voltage is in the range of 12 to 14 volts and said supply voltage is in the range of 36 to 42 volts.

13. Circuit structure for controlling a voltage directed to a fuel injector, the fuel injector having an electromagnetic coil which, when actuated with a nominal voltage, opens the fuel injector, said nominal voltage being substantially less than a supply voltage, the circuit structure comprising:

a circuit constructed and arranged to be directly electrically connected with said coil and to step-down the supply voltage to be substantially said nominal voltage at said coil.

14. The circuit structure according to claim 13, in combination with a fuel injector having an electromagnetic coil, wherein said circuit is housed in an adapter having electrical connections constructed and arranged to mate with connections of said fuel injector to operate said coil.

15. The combination according to claim 14, wherein the electromagnetic coil defines a bucking coil of said circuit.

16. The combination according to claim 14, wherein said circuit includes an operational amplifier, a voltage reference, equal value resistors, a capacitor, a transistor having an output directed to said coil, and a pair of calibrating resistors constructed and arranged such that said operational amplifier in conjunction with said voltage reference and said equal value resistors establishes a hysteresis voltage range including an upper voltage and a lower voltage, said capacitor charges to said upper voltage and then discharges to said lower voltage to provide a voltage oscillation which results in a square wave signal being directed to said transistor, a duty cycle of said voltage oscillation being controlled by a ratio of said pair of calibrating resistors to provide the voltage step-down from the supply voltage to said nominal voltage.

17. The combination according to claim 16, wherein said calibrating resistors are constructed and arranged to provide a voltage step-down ratio of 3 to 1.

18. The circuit structure for controlling a voltage directed to a fuel injector according to claim 13, wherein said nominal voltage is in the range of 12 to 14 volts and said supply voltage is in the range of 36 to 42 volts.

19. A method of stepping-down a supply voltage to an electromagnetic coil of a fuel injector, said coil being constructed and arranged to operate at a nominal voltage substantially less than the supply voltage, the method comprising:

providing circuit structure directly electrically coupled with said coil to step-down the supply voltage to be substantially said nominal voltage at said coil.

20. The method according to claim 17, wherein said circuit structure includes an operational amplifier, a voltage reference, equal value resistors, a capacitor, a transistor having an output directed to said coil, and a pair of calibrating resistors, the method including:

establishing a hysteresis voltage range including an upper voltage and a lower voltage via said operational amplifier in conjunction with said voltage reference and said equal value resistors, charging said capacitor to said upper voltage and then discharging said capacitor to said lower voltage to provide a voltage oscillation which results in a square wave signal being directed to said transistor, and controlling a duty cycle of said voltage oscillation by a ratio of said pair of calibrating resistors to provide the voltage step-down from the supply voltage to said nominal voltage.

* * * * *